US012723407B2

(12) United States Patent
Stafford

(10) Patent No.: US 12,723,407 B2
(45) Date of Patent: Sep. 1, 2026

(54) Z-SHAPED FRAME MEMBERS, FLOOR FRAMES, AND FLOORS INCORPORATING THE SAME

(71) Applicant: Stockton Products, North Las Vegas, NV (US)

(72) Inventor: James Ellarbee Stafford, Oakley, CA (US)

(73) Assignee: STOCKTON PRODUCTS, Las Vegas, NV (US)

( * ) Notice: Subject to any disclaimer, the term of this patent is extended or adjusted under 35 U.S.C. 154(b) by 103 days.

(21) Appl. No.: 18/590,792

(22) Filed: Feb. 28, 2024

(65) Prior Publication Data

US 2024/0295123 A1 Sep. 5, 2024

Related U.S. Application Data

(60) Provisional application No. 63/487,753, filed on Mar. 1, 2023.

(51) Int. Cl.
*E06B 5/10* (2006.01)
*E04B 5/10* (2006.01)

(52) U.S. Cl.
CPC ..... *E04B 5/10* (2013.01)

(58) Field of Classification Search
CPC . E04B 5/10; E04B 1/2403; E04C 3/07; E04C 2003/0421; E04C 2003/0473
See application file for complete search history.

(56) References Cited

U.S. PATENT DOCUMENTS 5,313,752 A * 5/1994 Hatzinikolas ..... E04B 2/58 52/690
5,596,859 A * 1/1997 Horton ..... E04B 2/7453 52/656.6
5,625,995 A * 5/1997 Martin ..... E04B 5/10 52/715
6,260,318 B1 * 7/2001 Herren ..... E04B 2/7453 52/696
6,301,854 B1 * 10/2001 Daudet ..... E04B 5/14 52/262
6,609,344 B2 * 8/2003 Saldana ..... E04B 5/14 52/696
7,240,459 B2 * 7/2007 Daudet ..... E04C 3/07 52/289
7,451,575 B2 * 11/2008 Hall ..... F16B 9/052 248/200.1
7,870,698 B2 * 1/2011 Tonyan ..... E04B 1/0007 428/192
7,975,446 B2 * 7/2011 Hall ..... E04B 5/10 52/696
8,091,316 B2 * 1/2012 Beck ..... E04B 5/10 52/289

(Continued)

*Primary Examiner* — Beth A Aubrey
(74) *Attorney, Agent, or Firm* — Womble Bond Dickinson (US) LLP

(57) ABSTRACT

A unitary Z-shaped member is formed from a single piece of material and includes a web having a first end opposite a second end, a first flange extending from the first end in a first direction, a second flange extending from the second end in a second direction opposite the first direction, and at least a first tab extending from the web for connecting with a stud. A floor frame includes such Z-shaped member. The floor frame may be mounted on wall ends to define a floor.

16 Claims, 8 Drawing Sheets

(56) References Cited

U.S. PATENT DOCUMENTS

| | | | | |
|---|---|---|---|---|
| 9,777,479 | B2 * | 10/2017 | Rice | E04B 1/24 |
| 11,028,580 | B2 * | 6/2021 | Burt | E04C 3/07 |
| 2002/0062611 | A1 * | 5/2002 | Pryor | E04B 7/20 52/404.1 |
| 2003/0145537 | A1 * | 8/2003 | Bailey | E04B 2/767 52/481.1 |
| 2004/0163356 | A1 * | 8/2004 | Rice | E04C 3/07 52/836 |
| 2004/0200172 | A1 * | 10/2004 | Beck | E04B 5/10 52/506.03 |
| 2016/0186424 | A1 * | 6/2016 | Meyer | E04B 1/24 52/702 |
| 2019/0376283 | A1 * | 12/2019 | Hirayama | E04B 5/40 |
| 2020/0340247 | A1 * | 10/2020 | Ryan | B21D 53/00 |

* cited by examiner

Z-SHAPED FRAME MEMBERS, FLOOR FRAMES, AND FLOORS INCORPORATING THE SAME

CROSS REFERENCE TO RELATED APPLICATION

This application is based upon and claims priority to U.S. Application No. 63/487,753, filed on Mar. 1, 2023, the contents of which are fully incorporated herein by reference.

BACKGROUND

Upper flooring in building structures is often formed by creating a horizontally extending floor frame that is mounted on vertical walls and then placing a concrete board over such frame. Such frames require a lot of hardware and a lot of time to install. Frames that are more efficient requiring less hardware and less time to install are desired.

SUMMARY OF THE INVENTION

In an example embodiment, a Z-shaped member includes a web having a first end opposite a second end, a first flange extending from the first end in a first direction, a second flange extending from the second end in a second direction opposite the first direction, and at least a first tab extending from the web for connecting with a stud, wherein the entire member is formed from a single piece of material. In another example embodiment, the at least one tab is formed by punching out a portion of the web. In yet another example embodiment, a plurality of tabs extend from the web, and the plurality of tabs are formed by being punched from the web. In one example embodiment, the Z-shaped member has a length extending between a third end and a fourth end, and the web first end and second end extend along such length, however, the first flange does not extend to the third end and the fourth end.

In a further example embodiment, a floor frame includes a first unitary Z-shaped member having a first web, an upper first flange extending in a first direction from the first web, a lower second flange extending from the first web in a second direction opposite the first direction, and a plurality of spaced apart first tabs punched from the first web and extending in the second direction. The floor frame further includes a second unitary Z-shaped member opposite the first Z-shaped member having a second web, an upper third flange extending in the second direction from the second web, a lower fourth flange extending from the second web in the first direction, and a plurality of spaced apart second tabs punched out from the second web and extending in the first direction. In addition, the floor frame incudes a first end member connected to the first and second unitary Z-shaped members and extending between the first and second unitary Z-shaped members, the first end member having a third web and an upper fifth flange extending transversely from the third web in a third direction. The floor frame also includes a second end member connected to the first and second unitary Z-shaped members and extending between the first and second unitary Z-shaped members, the second end member having a fourth web and an upper sixth flange extending transversely from the fourth web in a fourth direction opposite the third direction. The second end member is opposite the first end member, and the first and second unitary Z-shaped members and the first and second end members define a periphery of the floor frame. The floor frame also includes a plurality of intermediate members, each intermediate member including a fifth web and an upper seventh flange extending transversely from the fifth web. Each intermediate member web is connected to a first tab of the plurality of first tabs and to a second tab of the plurality of second tabs. In yet a further example embodiment, each end member is a channel. In one example embodiment, each intermediate member is a C-Stud further including a lower eighth flange extending transversely from the fifth web. In another example embodiment, the floor frame further includes a plurality of retainers mounted to a lower surface of the plurality of intermediate members and for mounting to a wall. In yet another example embodiment, the floor frame further includes a ninth flange coupled to the first end member and extending in a direction opposite the fifth flange, and a tenth flange coupled to the second end member and extending in a direction opposite the sixth flange. In a further example embodiment, the floor frame includes a first angle member mounted to the first end member, the first angle member having a first leg mounted to the first end member and a second leg extending transversely from the first leg, wherein the second leg forms the ninth flange, and a second angle member mounted to the second end member, the second angle member having a first leg mounted to the second end member and a second leg extending transversely from the first leg of the second angle member, wherein second leg of the second member forms the tenth flange. In one example embodiment, the first unitary Z-shaped member extends along a first length between a first end and a second end of the first unitary Z-shaped member, and the second unitary Z-shaped member extends along a second length between a first end and a second end of the second unitary Z-shaped member, while the first flange does not extend to the first and the second ends of the first unitary Z-shaped member, and the third flange does not extend to the first and second ends of the second unitary Z-shaped member.

In an example embodiment a structure includes an example embodiment floor frame and also includes a first vertical wall having an upper end surface, and a second vertical wall spaced apart from the first vertical wall and having an upper end surface. With this example embodiment, the first flange is over the upper end surface of the first wall, and the third flange is over the upper end surface of the second wall. In a further example embodiment, the structure also includes a third vertical wall having an upper end surface and extending between the first and second walls, and a fourth vertical wall having an upper end surface and spaced apart from the third vertical wall and extending between the first and second vertical walls. With this example embodiment, the ninth flange is over the upper end surface of the third wall, the tenth flange is over the upper end surface of the fourth wall. In yet a further example embodiment, the first web is connected to the first wall, and the second web is connected to the second wall. In another example embodiment, the structure further includes a first retainer is connected to the second flange and to the first vertical wall, a second retainer connected to the fourth flange and to the second vertical wall, a third retainer connected to a lower flange of the first end member and to the third wall; and a fourth retainer connected to a lower flange of the second end member and to the fourth wall. In yet another example embodiment, the structure also includes a sheath over the floor frame and fastened to the first flange and the first wall. In a further example embodiment, the sheath is a concrete board. In a further example embodiment, the structure further includes a plurality of resilient channel members below the intermediate members, adjacent to the eight flanges of the intermediate members and extend perpendicular to the intermediate members. The resilient channel members are spaced apart from each other, and each resilient channel member has a first end portion opposite a second end portion, such that the first end portion extends over and is supported by a flange of the third retainer and the second end portion extends over and is supported by a flange of the fourth retainer. In one example embodiment, the first and second vertical walls are bearing walls. In another example embodiment, a first flange of another floor frame is over the upper end of the first wall.

DETAILED DESCRIPTION OF THE INVENTION

Figure 1:
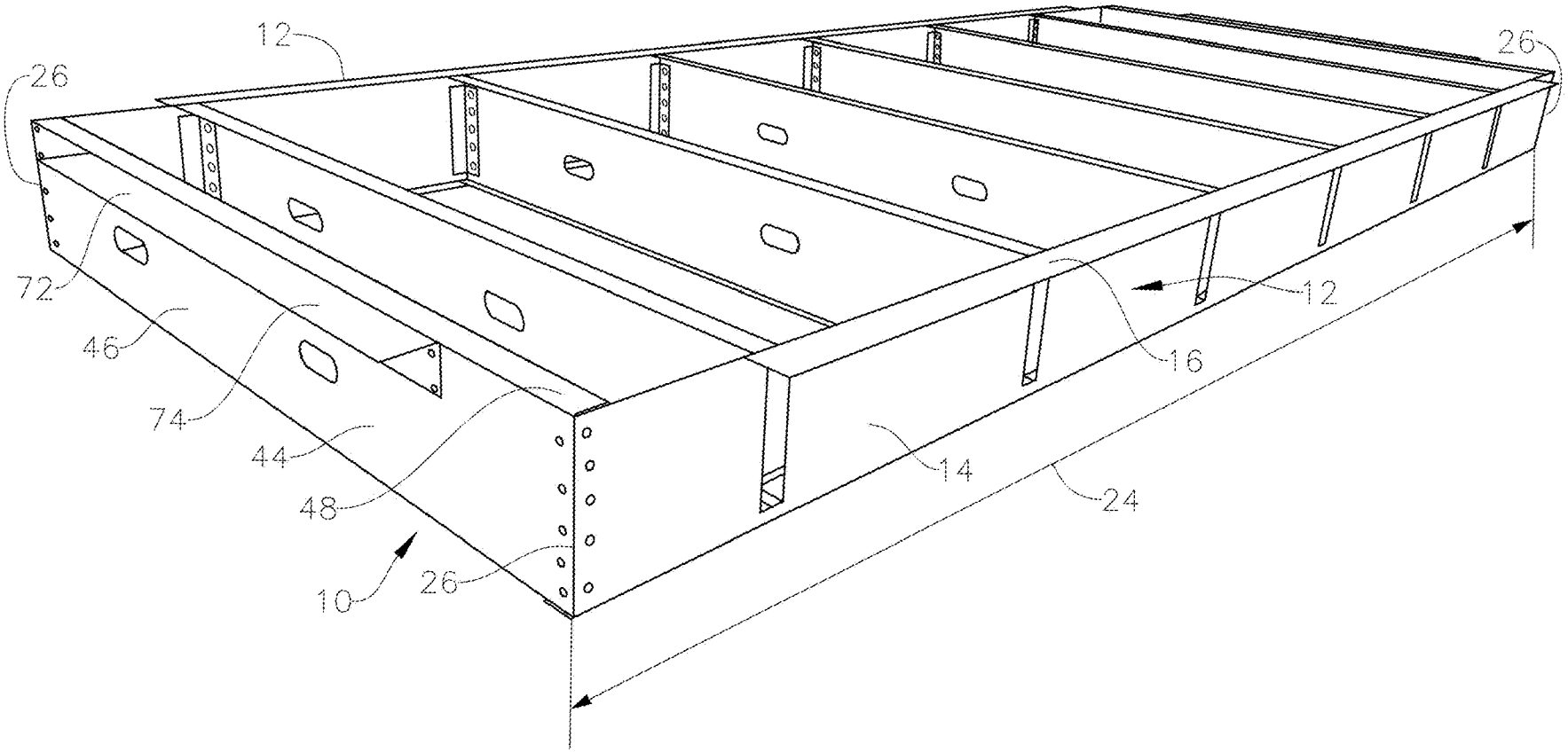
FIG. 1 is a perspective view of an example embodiment floor frame.
Figure 2:
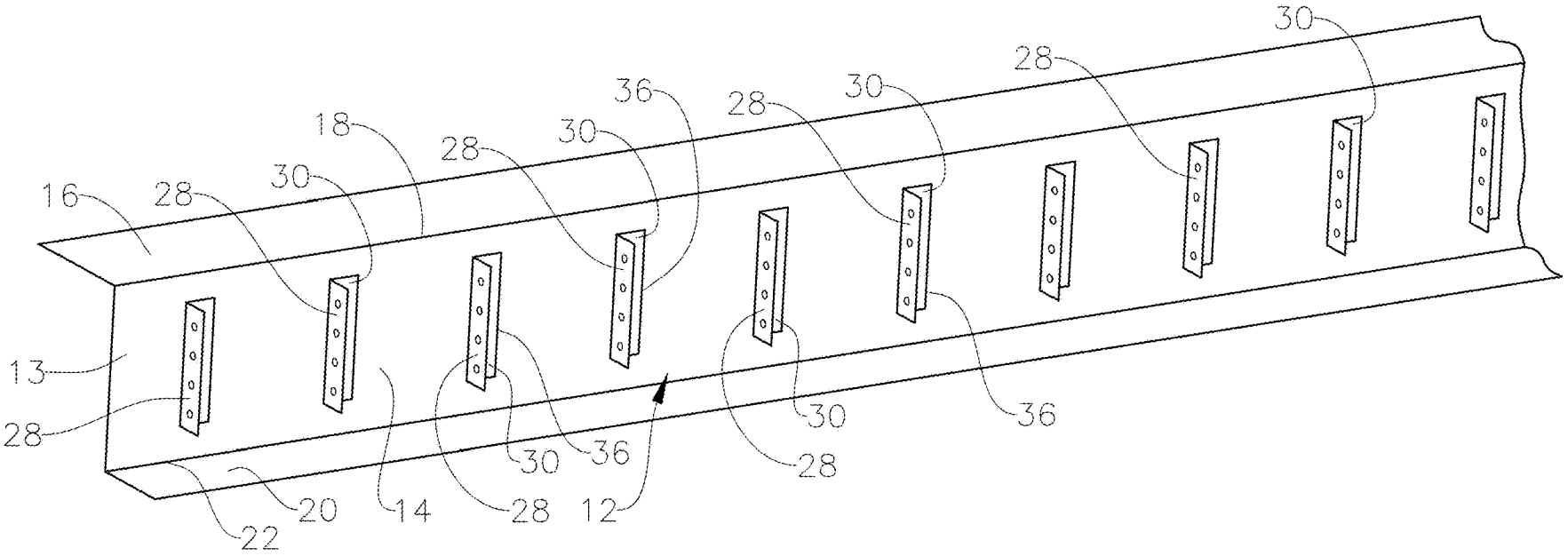
FIG. 2 is a perspective view of an example embodiment Z-shaped frame member.
Figure 3:
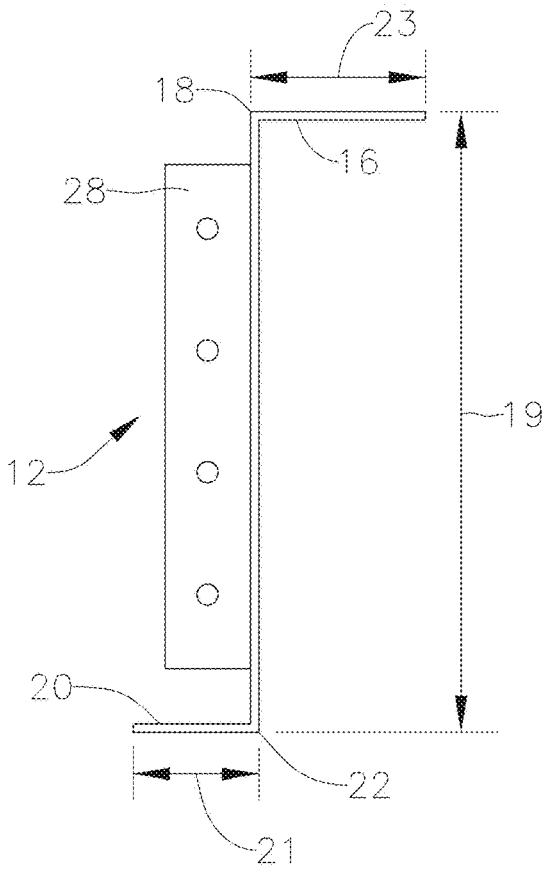
FIG. 3 is an end view of the example embodiment Z-shaped frame member shown in FIG. 2

An example embodiment floor frame 10 includes two opposite Z-shaped frame members 12, referred to as "Z members" herein, as shown in FIG. 1. Each Z member has a vertical portion or web 14, an upper portion, or upper flange 16, extending generally perpendicularly from an upper end 18 of the web and a lower portion, or lower flange 20, extending perpendicularly or generally perpendicularly from a lower end 22 of the web and in a direction opposite the upper portion so as to define a Z shape in cross-section, as for example shown in FIG. 2. In an example embodiment, the web 14 extends along a length 24 and the upper flange 16 does not extend along the entire length of the web such that it does not extend to the opposite ends 26 of the web defining the length 24, as for example shown in FIG. 1. In an example embodiment as shown in FIGS. 2 and 3, the upper flange extends perpendicularly or generally perpendicularly from the web a longer distance than the lower flange. For example, as shown in FIG. 3, the upper flange has a length 23 that is greater than the length 21 of the lower flange. In an example embodiment, the upper flange has a length 23 of 3 inches as measured from the web, and the lower flange has a length 21 of 2 inches as measured from the web. In an example embodiment as shown in FIG. 3 the web has a length 19 in cross-section of 10 inches.

Tabs 28, and in an example embodiment, rectangular tabs are punched from the web 14, defining openings 30 through the web, at predetermined intervals and extend in the same direction as the lower flange 20, as for example shown in FIG. 2. To punch each tab, a first and a second spaced apart horizontal (or generally horizontal) cuts 32, 34 and a vertical (or generally vertical) cut 36 are formed through the web 14, as for example shown in FIG. 2. Each horizontal cut extends from a first end 38 to a second end 40 in the same direction. The vertical cut extends from the first end 38 of the first horizontal cut to the first end 38 of the second horizontal cut. The tab 18 is bent out (e.g., punched out) along an axis 42 extending from the second end 40 of the first horizontal cut to the second end 40 of the first horizontal cut. Once bent the tab extends perpendicularly or generally perpendicularly to the web of the Z member. In an example embodiment, each Z member is a unitary structure in that it is formed entirely by bending a single sheet of material or panel 13 to have the Z-shape shape and then punching the tabs through its web.

Figure 4:
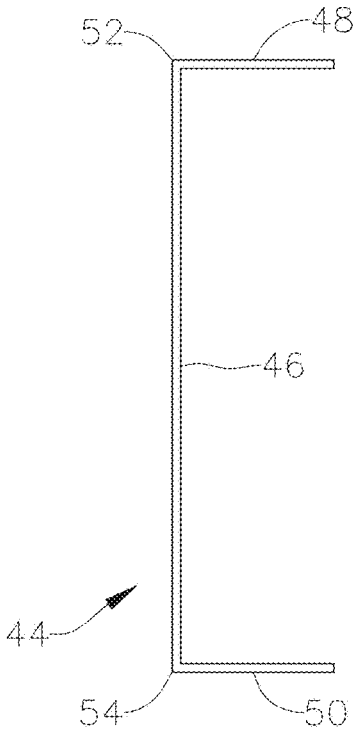
FIG. 4 is an end view of an example embodiment end member incorporated in the floor frame shown in FIG. 1.

Two end members 44 (FIGS. 1 and 4) are connected to the Z members at each end, as for example shown in FIG. 1. In an example embodiment, each end member 44 is a channel shaped member (referred to herein as a "channel") having a vertical portion, or web 46 and two generally horizontally flanges (an upper flange 48 and a lower flange 50) extending in the same direction from upper and lower ends 52, 54 of the channel web 46. In an example embodiment, the web of each channel has the same height as the web of each Z member. An end of each channel web is connected to an end of each Z member web respectively. In an example embodiment, this accomplished by using an angle member (not shown) that is attached, in an example embodiment by fasteners 56 (FIG. 1), to the inner surfaces of the webs of each channel member and Z member proximate their corresponding ends. In this regard, the two Z members and the two channels define the perimeter of the floor frame which is a quadrilateral with each Z member and each channel defining a side of the quadrilateral.

Figure 5:
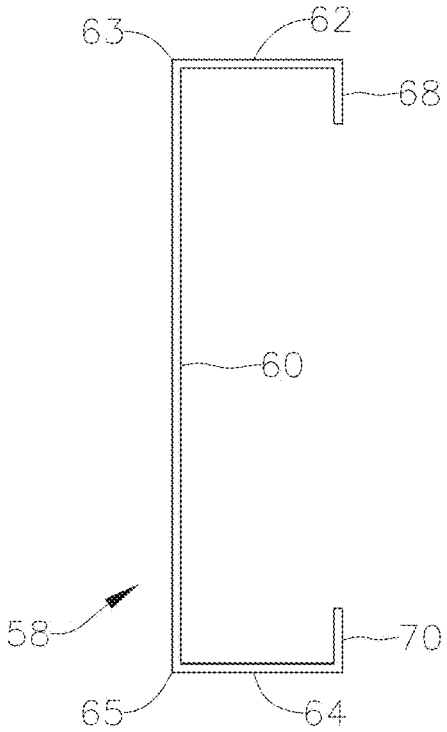
FIG. 5 is an end view of an example embodiment intermediate member incorporated in the floor frame shown in FIG. 1.
Figure 7:
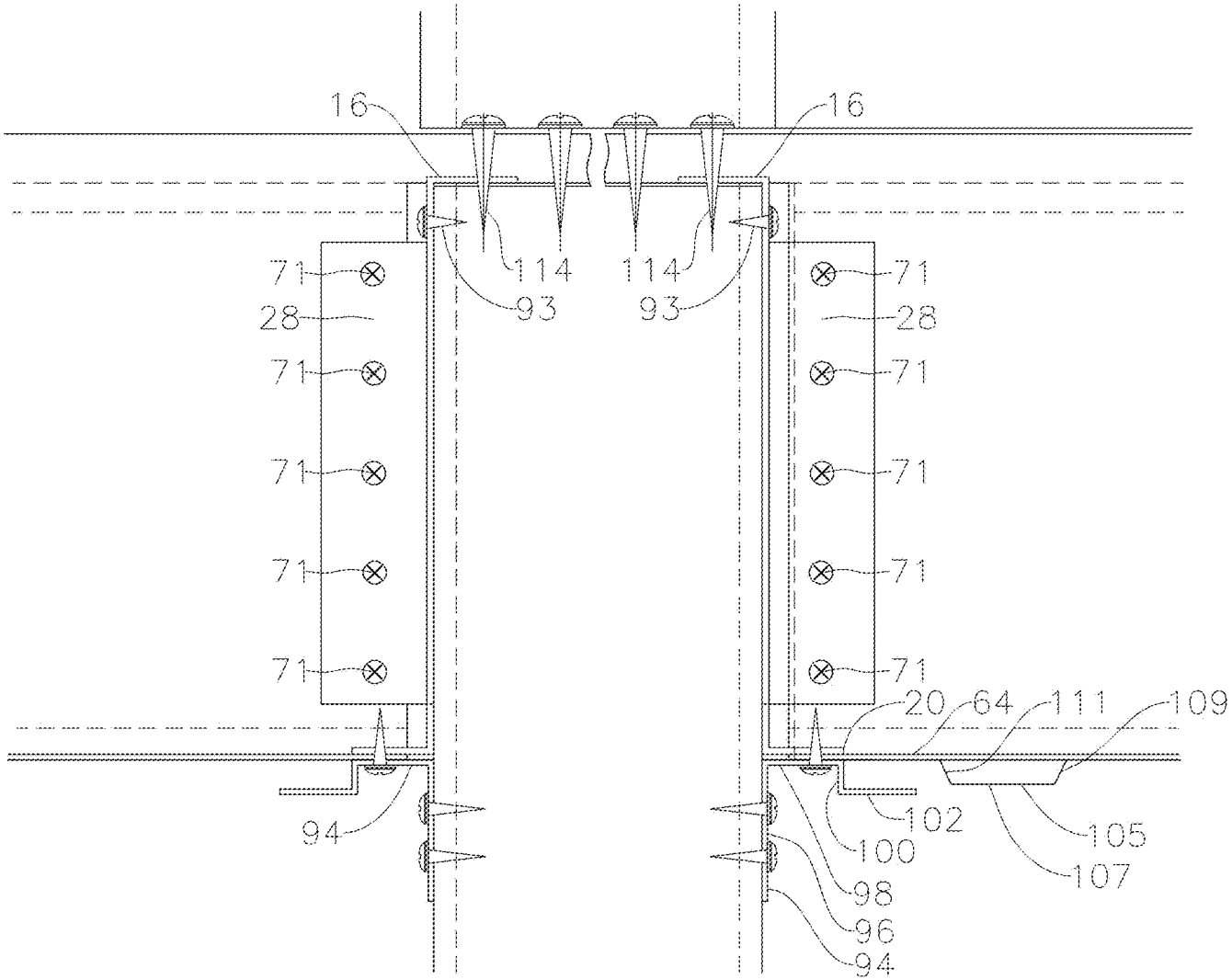
FIG. 7 is end is a partial cross-sectional view, perpendicular to the view shown in FIG. 6B, of the example embodiment floor frame mounted on a bearing wall.

Intermediate members 58, which in an example embodiment are C-Studs having a central web 60 and upper and lower flanges 62, 64, extending distally from upper and lower ends 63, 65, respectively of the C-Stud web 60, are connected to corresponding tabs 28 of each Z member (FIGS. 5 and 7). Each C-Stud has an upper lip 68 extending downward from the distal end of the upper flange, and a lower lip 70 extending upward from the distal end of the lower flange. In an example embodiment, instead of C-Studs, I-beams or channels may be used. In an example embodiment, the webs of each C-Stud are fastened proximate their opposite ends to the corresponding tabs of each Z member. In an example embodiment, this is accomplished by using fasteners 71.

A support angle 72 is attached, and in an example embodiment fastened to an outer surface of each end member (e.g., channel member) 44, such that a leg 74 of each support angle member extends in a direction away from the upper flange 48 of each end member 44, as for example shown in FIGS. 1 and 6. In an example embodiment, the upper surfaces of the upper flanges of the Z members, the end members, intermediate members and the support angle legs 48 all extend along the same.

Figure 6A:
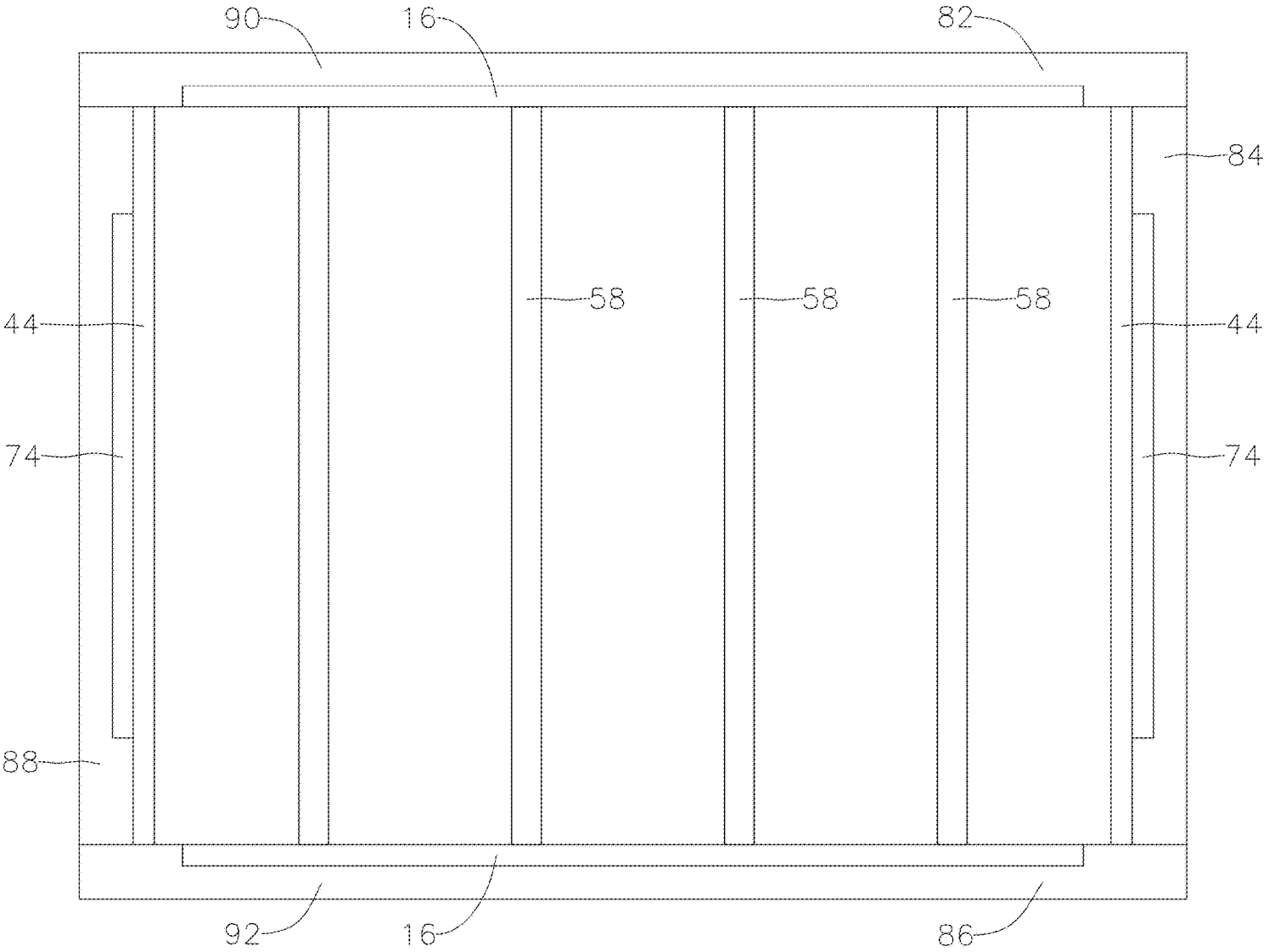
FIG. 6A is a top view of the example embodiment floor frame shown in FIG. 1.

In an example embodiment, the floor frame is attached to four walls 82, 84, 86, 88 forming a room, where at least two opposite walls 82, 86 are bearing walls, as for example shown in FIG. 6A. An upper flange 16 of the first Z-member is rested on an upper end 90 of a first of the two bearing walls and an upper flange of the second Z-member is rested on an upper end 92 of a second of the two bearing walls opposite the first. Each leg 74 of the angle connected to the end member is rested on each of the other two opposite walls, respectively. The webs 14 of each Z member may be attached to the bearing walls 82, 86. In one example embodiment, this may be accomplished by using fasteners 93.

Figure 6B:
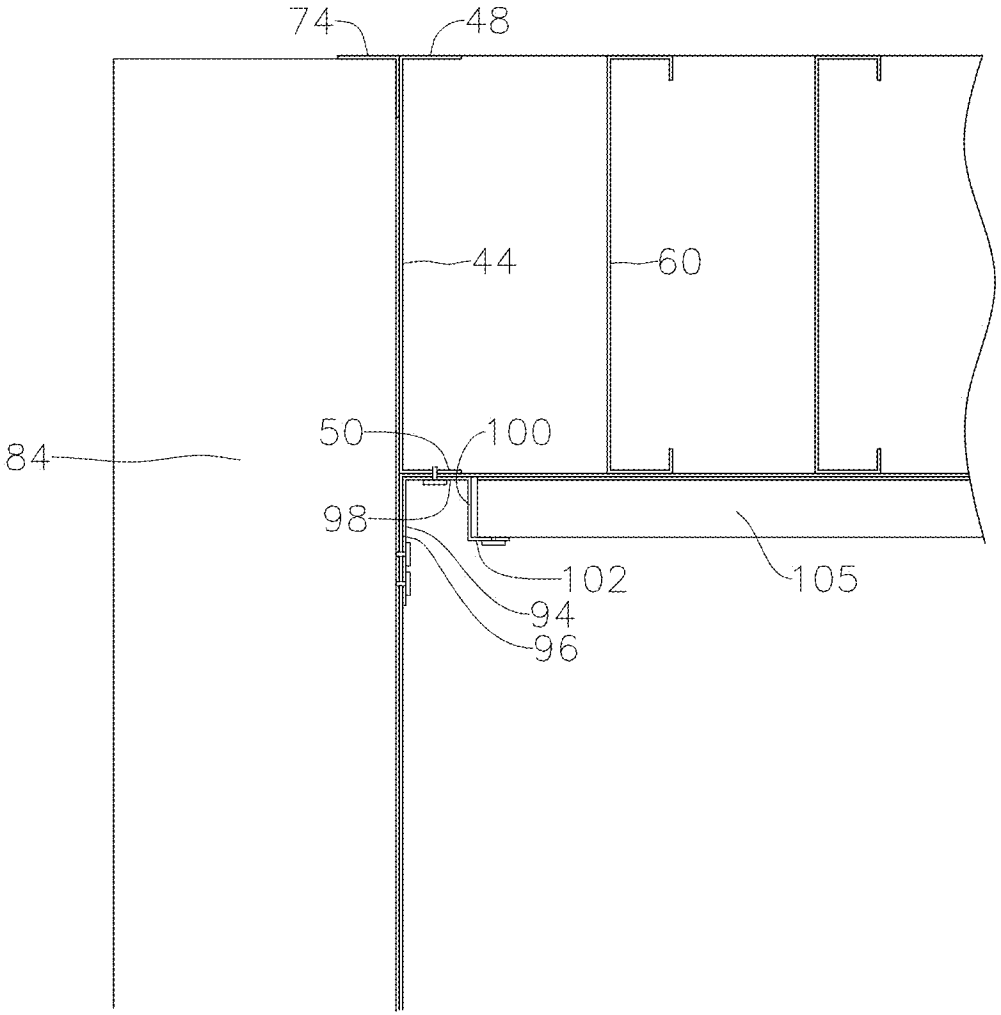
FIG. 6B is a partial end cross-section view of the example embodiment floor frame shown in FIG. 1 mounted on a wall.
Figure 6C:
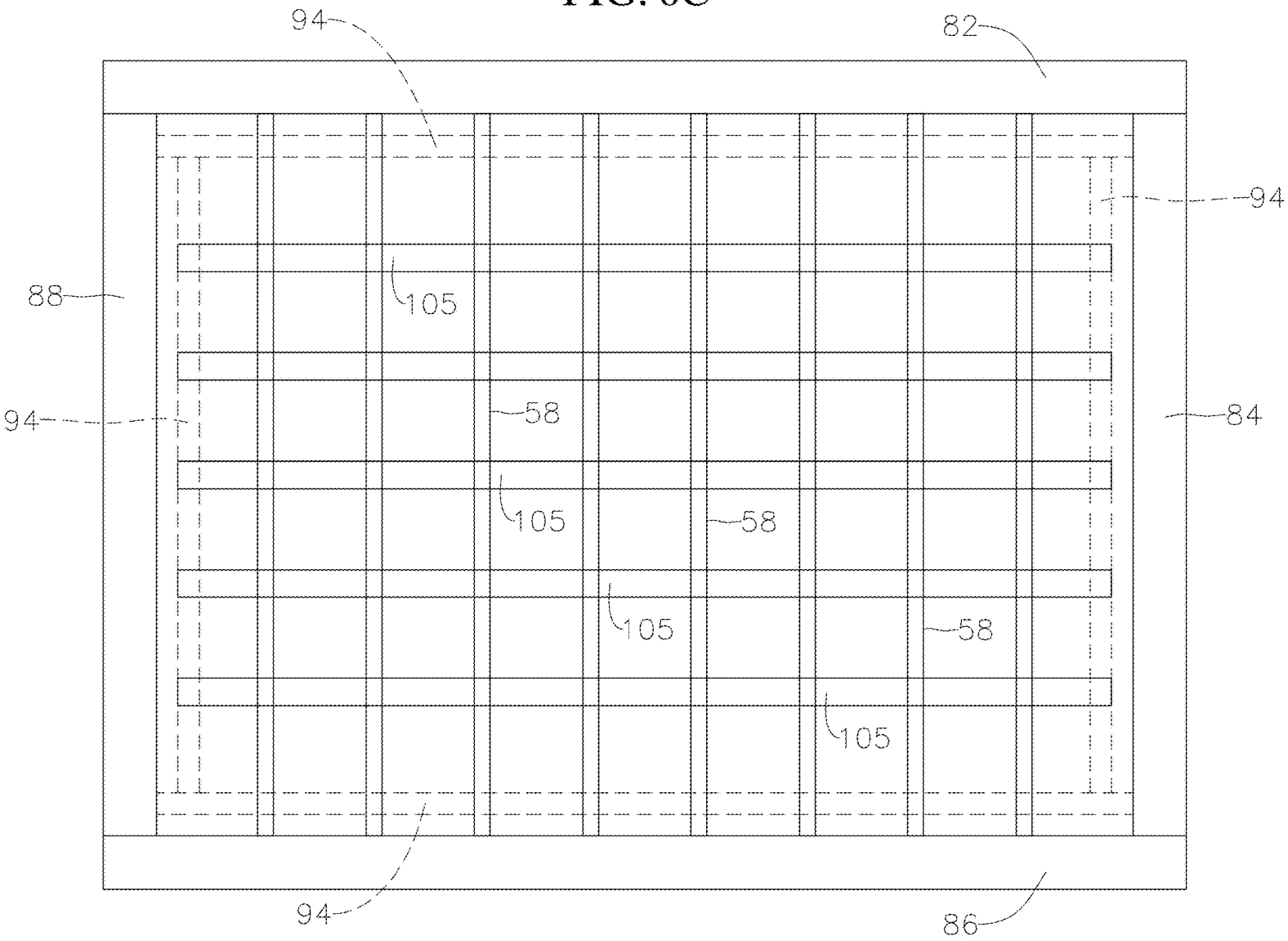
FIG. 6C is a top view of the example embodiment floor frame as disclosed in FIG. 6A without the Z members and end members for illustrative purposes and including the retainers and resilient channel members.

In an example embodiment, retainers 94 are mounted on each wall 82, 84, 86, 88 to support the Z members 12 and the end members 44 at their lower flanges 20, 50, as for example shown in FIGS. 6B and 6C. In an example embodiment, each retainer is a bracket having a first leg 96 for mounting onto the bearing wall and a second leg 98 for mounting and supporting the lower flange 20, 50 of the Z member and end member, respectively, a third leg 100 extending transversely from the second leg 98 in the same direction as the first leg 96 and parallel or generally parallel to the first leg, and a fourth leg 102 extending transversely from the third leg in a direction away from the second leg, and parallel or generally parallel to the second leg. When connected to the lower flanges 20 of the Z members, the retainers may also be connected to the lower flanges 64 of the intermediate members. This example embodiment allows for the retainer to support resilient channels members 105 (also referred to herein as "resilient channels") that are mounted below the frame transverse to the intermediated members 58 and generally parallel to the Z members. In an example embodiment as shown in FIGS. 6B and 7, the resilient channels comprise a web 107, a first flange 109 extending transversely from one end of the web 107, a second flange 111 extending transversely from an opposite end of the web 107, and a third flange 113 extending transversely from the second flange 111 in a direction away from the web 107 and parallel to the web 107. In the shown example embodiment, the first and second flanges, 109, 111 of the resilient channel extend away obliquely from the web so as to define a truncate cone shape in cross-section as for example shown in FIG. 7. Each resilient channel extends such that each of its ends is received over the flange 102 of a retainer extending along and below the end members 44 and is fastened to the flange 102, as for example shown in FIG. 7. In this regard, the retainers support opposite ends of each of the resilient channels. The resilient channels also extend across the intermediate members and immediately adjacent the lower flanges 64 of the intermediate members. In example embodiments, each resilient channel 105 may also be connected to the lower flanges 64 of the intermediate members 58. The resilient channels help with sound attenuation through the floor and more importantly serve to keep the studs in alignment for a prescribed period of time (for example, two hours) due to overheating during a fire.

A floor board 110, and in an example embodiment a concrete sheath, is placed over the frame extending over the walls. In an example embodiment, the floor board extends the entire thickness 112 of the bearing walls, 82, 86. In another example embodiment, where another floor frame 10 is supported by the same bearing wall, as for example shown in FIG. 7, the floor board extending over each floor frame extends across approximately half of the bearing wall thickness, as for example shown in FIG. 7. The floor board is fastened to the bearing wall 82, 86 through the upper flange 16 of the Z-members, using fasteners 114. In another example embodiment, instead of a single floor board multiple, floor boards may be used adjacent to each other and fastened to the upper flanges of the intermediate members, the Z-members and/or the end members.

Figure 8:
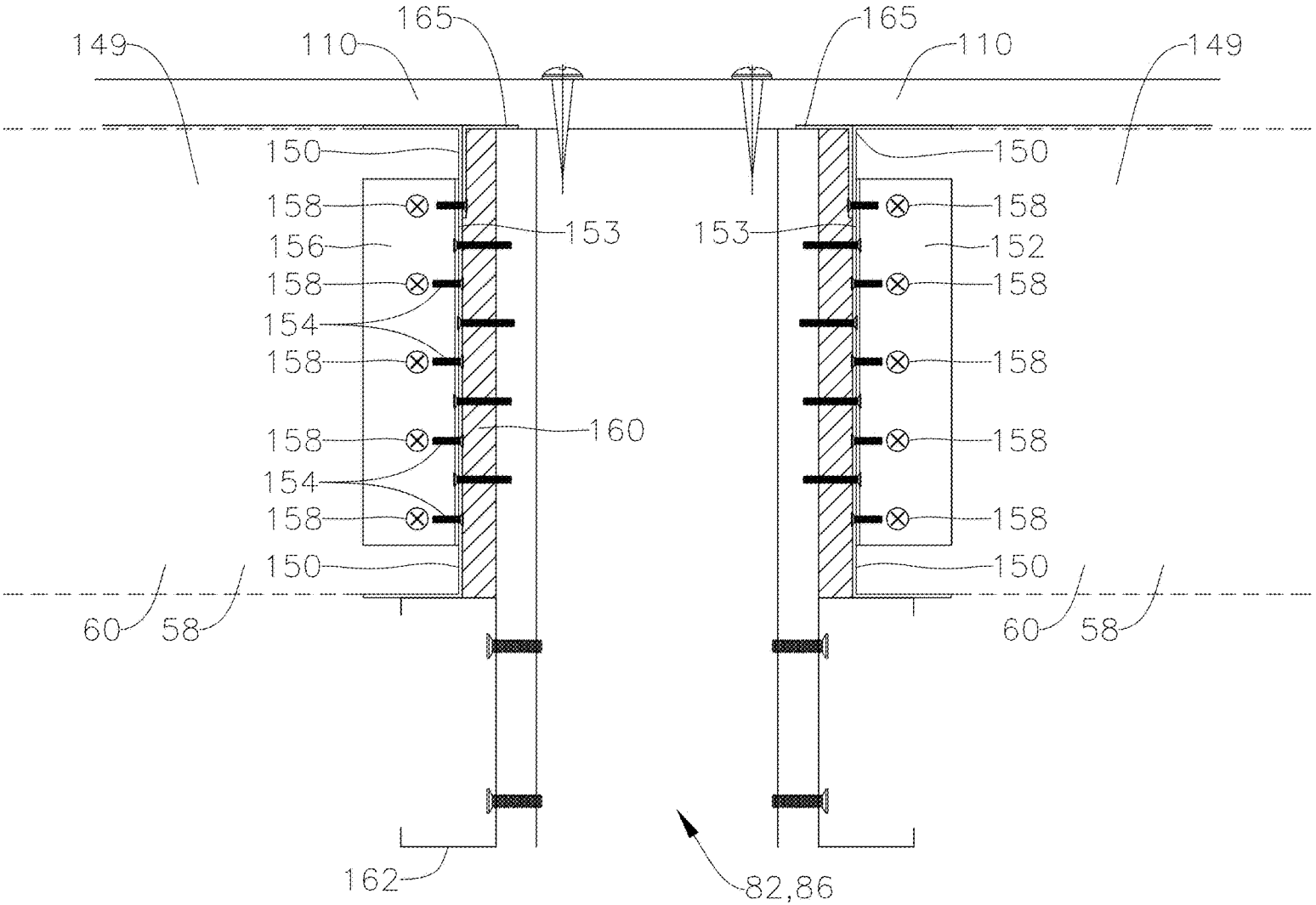
FIG. 8 PRIOR ART
FIG. 8 is a partial cross-sectional view of a prior art floor frame mounted on a bearing wall.

The example embodiment floor frame described herein using the example embodiment Z member provides significant improvements from the prior art floor frames 149 currently being used to form floors. For example, as shown in FIG. 8, instead of Z members, channel members 150 are used, as for example shown in FIG. 8. Angle members 152 are used to connect the channel members 150 to the intermediate members. Each angle member has a first leg 153 connected using multiple fasteners 154, as for example five, to a channel member 150, and a second leg 156 attached to the web 60 of the intermediate members using a plurality of fasteners 158, as for example five fasteners. A plurality of additional fasteners 162, as for example five fasteners 162 are then used to connect the angle 152 and the intermediate member 58 connected to the angle to the wall 8, 86. With the example embodiment Z member, instead of the angle, tabs 8 are used and a such one third of the fasteners used in the prior art are used to connect the tabs and the Z member from which they extend to the wall 82, 86. In addition the prior art floor frame requires shims 160 placed between the channel members 150 and the wall 82, 86. Shims are not required when using the example embodiment floor frame described herein mainly because of the Z members and the retainers 94. Moreover, with the prior art floor frames, studs 162 need to be mounted to the walls to support the floor frame prior to the installation of the floor frame. These studs are removed after installation of the floor frame. In addition, some prior art floor frames 149 may also include angles 165 that are connected to the channel members 150 and to the wall 82, 86.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Moreover, although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "generally," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" or "over" another component, it can be directly on or over the other component, or components may also be present therebetween. Moreover, when a component is component is referred to as being "coupled" to another component, it can be directly attached to the other component or intervening components may be present therebetween. In addition, the terms "first", "second", and "third" when referring to components are just labels for distinguishing such components from each other and are not the generic names of such components. For example, a component described as a "first" component in the specification may be recited in the claims as a "second" component.

What is claimed is:

1. A floor frame comprising:

a first unitary Z-shaped member having a first web, an upper first flange extending in a first direction from the first web, a lower second flange extending from the first web in a second direction opposite the first direction, and a plurality of spaced apart first tabs punched from the first web and extending in the second direction;

a second unitary Z-shaped member opposite the first Z-shaped member having a second web, an upper third flange extending in the second direction from the second web, a lower fourth flange extending from the second web in the first direction, and a plurality of spaced apart second tabs punched out from the second web and extending in the first direction;

a first end member connected to the first and second unitary Z-shaped members and extending between the first and second unitary Z-shaped members, said first end member having a third web and an upper fifth flange extending transversely from the third web in a third direction;

a second end member connected to the first and second unitary Z-shaped members and extending between the first and second unitary Z-shaped members, said second end member having a fourth web and an upper sixth flange extending transversely from the fourth web in a fourth direction opposite the third direction, wherein said second end member is opposite the first end member, wherein the first and second unitary Z-shaped members and the first and second end members define a periphery of the floor frame; and a plurality of intermediate members, wherein each of said plurality of intermediate members comprises a fifth web, an upper seventh flange extending transversely from the fifth web, wherein each of the plurality of intermediate member fifth webs is connected to a first tab of said plurality of first tabs and to a second tab of said plurality of second tabs.

2. The floor frame of claim 1, wherein each of the end members is a channel.

3. The floor frame of claim 1, wherein each of the plurality of intermediate members is a C-Stud further comprising a lower eighth flange extending transversely from the fifth web.

4. The floor frame of claim 3, further comprising a plurality of retainers mounted onto a lower surface of said plurality of intermediate members and for mounting to a wall.

5. The floor frame of claim 3, further comprising:

a ninth flange coupled to the first end member and extending in a direction opposite the fifth flange; and a tenth flange coupled to the second end member and extending in a direction opposite the sixth flange.

6. The floor frame of claim 5, further comprising:

a first angle member mounted to the first end member, the first angle member having a first leg mounted to the first end member and a second leg extending transversely from the first leg, wherein said second leg forms the ninth flange; and a second angle member mounted to the second end member, the second angle member having a first leg mounted to the second end member and a second leg extending transversely from the first leg of the second angle member, wherein second leg of said second member forms the tenth flange.

7. The floor frame of claim 1 wherein the first unitary Z-shaped member extends along a first length between a first end and a second end of said first unitary Z-shaped member, wherein the second unitary Z-shaped member extends along a second length between a first end and a second end of said second unitary Z-shaped member, wherein the first flange does not extend to the first and the second ends of the first unitary Z-shaped member, and wherein the third flange does not extend to the first and second ends of the second unitary Z-shaped member.

8. A structure comprising the floor frame of claim 5, comprising:

a first vertical wall having an upper end surface; and a second vertical wall spaced apart from the first vertical wall and having an upper end surface, wherein, the first flange is over the upper end surface of the first wall, and the third flange is over the upper end surface of the second wall.

9. The structure of claim 8, further comprising a third vertical wall extending between the first and second walls, said third vertical wall having an upper end surface; and a fourth vertical wall spaced apart from the third vertical wall and extending between the first and second vertical walls, said fourth vertical wall having an upper end surface, wherein the ninth flange is over the upper end surface of the third wall, and the tenth flange is over the upper end surface of the fourth wall.

10. The structure of claim 9, wherein the first web is connected to the first wall, and the second web is connected to the second wall.

11. The structure of claim 8, further comprising:

a first retainer is connected to the second flange and to the first vertical wall;

a second retainer connected to the fourth flange and to the second vertical wall;

a third retainer connected to a lower flange of the first end member and to the third wall; and a fourth retainer connected to a lower flange of the second end member and to the fourth wall.

12. The structure of claim 11, further comprising a sheath over the floor frame and fastened to the first flange and the first wall.

13. The structure of claim 12, wherein the sheath is a concrete board.

14. The structure of claim 11, further comprising a plurality of resilient channel members below the intermediate members and perpendicular to the intermediate members, said resilient channel members being spaced apart and adjacent the eighth flanges of the intermediate members, wherein each of the plurality of resilient channel members has a first end portion opposite a second end portion, wherein the first end portion extends over and is supported by a flange of the third retainer and wherein the second end portion extends over and is supported by a flange of the fourth retainer.

15. The structure of claim 8, wherein the first and second vertical walls are bearing walls.

16. The structure of claim 8, wherein a first flange of another floor frame is over the upper end of the first wall.

* * * * *